US009798341B2

(12) United States Patent
Tomioka

(10) Patent No.: US 9,798,341 B2
(45) Date of Patent: Oct. 24, 2017

(54) VOLTAGE REGULATOR AND SEMICONDUCTOR DEVICE

(71) Applicant: Seiko Instruments Inc., Chiba-shi, Chiba (JP)

(72) Inventor: Tsutomu Tomioka, Chiba (JP)

(73) Assignee: SII Semiconductor Corporation (JP)

( * ) Notice: Subject to any disclaimer, the term of this patent is extended or adjusted under 35 U.S.C. 154(b) by 46 days.

(21) Appl. No.: 14/591,415

(22) Filed: Jan. 7, 2015

(65) Prior Publication Data

US 2015/0205313 A1 Jul. 23, 2015

(30) Foreign Application Priority Data

Jan. 17, 2014 (JP) ..... 2014-007147

(51) Int. Cl.
*G05F 1/56* (2006.01)
*G05F 1/575* (2006.01)

(52) U.S. Cl.
CPC ..... *G05F 1/56* (2013.01); *G05F 1/561* (2013.01); *G05F 1/562* (2013.01); *G05F 1/575* (2013.01)

(58) Field of Classification Search
CPC ..... G05F 1/56
USPC ..... 323/280
See application file for complete search history.

(56) References Cited

U.S. PATENT DOCUMENTS

2003/0011952 A1* 1/2003 Fukui ..... G05F 1/573 361/93.1
2003/0090251 A1* 5/2003 Nakashimo ..... G05F 1/575 323/280
2005/0068266 A1* 3/2005 Sano ..... G09G 3/296 345/60
2008/0001661 A1* 1/2008 Tachibana ..... H03F 3/347 330/253
2008/0100276 A1* 5/2008 Negoro ..... G05F 1/565 323/285
2008/0258696 A1* 10/2008 Kimura ..... G05F 1/56 323/269
2009/0201618 A1* 8/2009 Hasegawa ..... G05F 1/573 361/93.9
2009/0212753 A1* 8/2009 Lou ..... G05F 1/563 323/277
2009/0273237 A1* 11/2009 Inoue ..... G05F 1/575 307/10.1
2010/0090665 A1* 4/2010 Jian ..... G05F 1/573 323/277

FOREIGN PATENT DOCUMENTS

JP 2002-343874 11/2002

* cited by examiner

*Primary Examiner* — Jue Zhang
*Assistant Examiner* — Trinh Dang
(74) *Attorney, Agent, or Firm* — Brinks Gilson & Lione

(57) ABSTRACT

Provided is a voltage regulator including a clamp circuit capable of protecting a gate of an output transistor without limiting a drivability of the output transistor. The voltage regulator includes a level shift circuit having an input terminal connected to the gate of the output transistor and an output terminal connected to an input of the clamp circuit. The clamp circuit is controlled by an output voltage of the level shift circuit.

10 Claims, 6 Drawing Sheets

VOLTAGE REGULATOR AND SEMICONDUCTOR DEVICE

RELATED APPLICATIONS

This application claims priority under 35 U.S.C. §119 to Japanese Patent Application No. 2014-007147 filed on Jan. 17, 2014, the entire content of which is hereby incorporated by reference.

BACKGROUND OF THE INVENTION

1. Field of the Invention

The present invention relates to a protection circuit for an output transistor of a voltage regulator.

2. Description of the Related Art

A related-art voltage regulator is now described. FIG. 6 is a circuit diagram illustrating the related-art voltage regulator.

The related-art voltage regulator includes an error amplifier circuit 104, a reference voltage circuit 103, an NMOS transistor 602, resistors 105 and 106, a diode 601, a ground terminal 100, an output terminal 102, and a power supply terminal 101.

The resistors 105 and 106 are connected in series between the output terminal 102 and the ground terminal 100, and divide an output voltage Vout generated at the output terminal 102. A voltage generated at a connection point of the resistors 105 and 106 is represented by Vfb. The error amplifier circuit 104 controls a gate voltage of the NMOS transistor 602 so that the voltage Vfb may approach a voltage Vref of the reference voltage circuit 103, to thereby control the NMOS transistor 602 to output an output voltage Vout from the output terminal 102. The diode 601 clamps the gate voltage of the NMOS transistor 602 so that the gate of the NMOS transistor is protected from a breakdown even if a voltage exceeding a withstand voltage of the gate of the NMOS transistor is input from the power supply terminal 101 (for example, see Japanese Patent Application Laid-open No. 2002-343874).

However, the related-art voltage regulator has a problem in that, because the gate of the NMOS transistor 602 is clamped by only the diode, a drivability of the NMOS transistor 602 is limited.

SUMMARY OF THE INVENTION

The present invention has been made in view of the above-mentioned problem, and provides a voltage regulator including a protection circuit for a gate of an output transistor, which does not limit a drivability of the output transistor.

In order to solve the related-art problem, a voltage regulator according to one embodiment of the present invention has the following configuration.

The voltage regulator includes: a power supply terminal configured to input a power supply voltage; a reference voltage circuit configured to output a reference voltage; an output transistor; an error amplifier circuit configured to amplify and output a difference between a divided voltage and the reference voltage, the divided voltage being obtained by dividing an output voltage output from the output transistor, to thereby control a gate of the output transistor; a clamp circuit connected between the gate of the output transistor and the power supply terminal; and a level shift circuit including an input terminal connected to the gate of the output transistor and an output terminal connected to an input terminal of the clamp circuit.

The clamp circuit of the voltage regulator according to one embodiment of the present invention is configured so that the clamp circuit operates when the output voltage of the error amplifier circuit decreases below a predetermined voltage, and hence the gate of the output transistor can be protected without limiting the drivability of the output transistor.

DETAILED DESCRIPTION OF THE PREFERRED EMBODIMENTS

In the following, embodiments of the present invention are described with reference to the drawings.

First Embodiment

Figure 1:
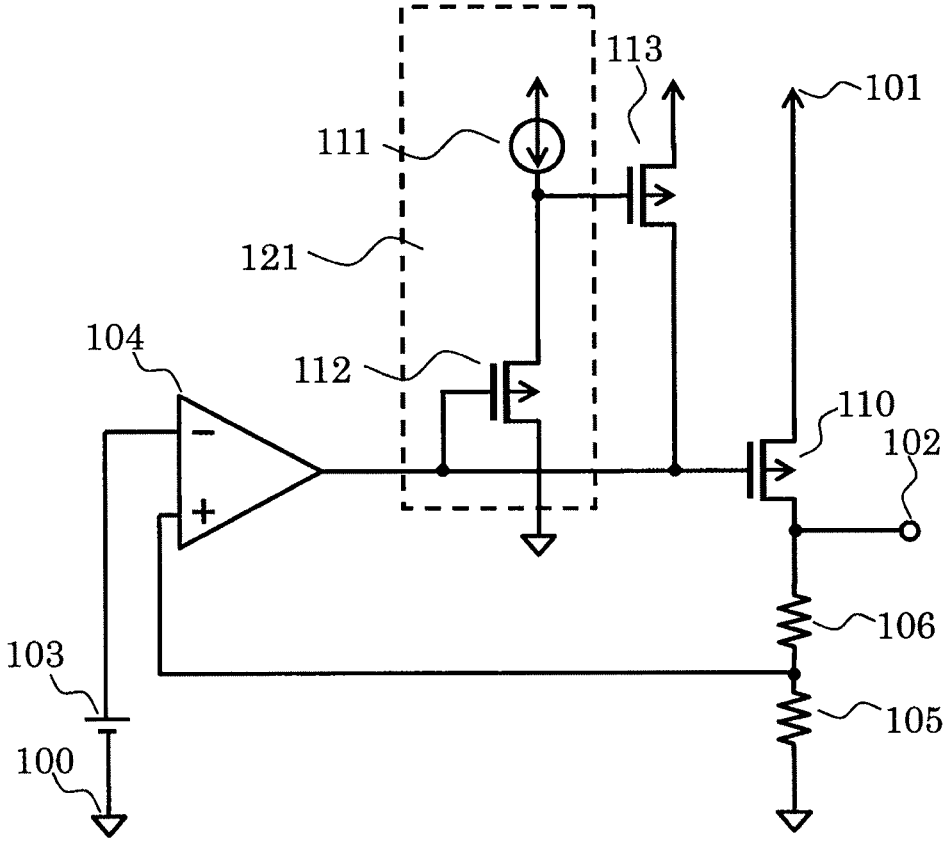
FIG. 1 is a circuit diagram illustrating a configuration of a voltage regulator according to a first embodiment of the present invention.

FIG. 1 is a circuit diagram of a voltage regulator according to a first embodiment of the present invention.

The voltage regulator according to the first embodiment includes an error amplifier circuit 104, a reference voltage circuit 103, an output transistor 110, PMOS transistors 112 and 113, resistors 105 and 106, a constant current circuit 111, a ground terminal 100, an output terminal 102, and a power supply terminal 101. The constant current circuit 111 and the PMOS transistor 112 form a level shift circuit 121. The PMOS transistor 113 is a clamp circuit for a gate of the output transistor 110.

Next, connections in the voltage regulator according to the first embodiment are described.

The resistor 105 and the resistor 106 are connected in series between the output terminal 102 and the ground terminal 100. The error amplifier circuit 104 has an inverting input terminal connected to a positive electrode of the reference voltage circuit 103 and a non-inverting input terminal connected to a connection point of the resistor 106 and the resistor 105. The output transistor 110 has a gate connected to an output terminal of the error amplifier circuit 104, a source connected to the power supply terminal 101, and a drain connected to the output terminal 102. The PMOS transistor 112 has a gate connected to the output terminal of the error amplifier circuit 104, a source connected to a gate of the PMOS transistor 113, and a drain connected to the ground terminal 100. The PMOS transistor 113 has a drain connected to the output terminal of the error amplifier circuit 104 and a source connected to the power supply terminal 101. The constant current circuit 111 has one terminal connected to the power supply terminal 101 and the other terminal connected to the gate of the PMOS transistor 113.

Next, an operation of the voltage regulator according to the first embodiment is described.

When a power supply voltage VDD is input to the power supply terminal 101, the voltage regulator outputs an output voltage Vout from the output terminal 102. The resistors 106 and 105 divide the output voltage Vout and output a divided voltage Vfb. The reference voltage circuit 103 outputs a reference voltage Vref. The error amplifier circuit 104 controls a gate voltage of the output transistor 110 so that the reference voltage Vref and the divided voltage Vfb have the same value, that is, the output voltage Vout is constant.

When the output voltage Vout is higher than a predetermined voltage, the divided voltage Vfb is higher than the reference voltage Vref. Hence, an output signal of the error amplifier circuit 104 (the gate voltage of the output transistor 110) is increased, and the output transistor 110 is turned off to reduce the output voltage Vout. In addition, when the output voltage Vout is lower than the predetermined voltage, operations opposite to the above-mentioned operations are performed to increase the output voltage Vout. In this way, the voltage regulator operates so that the output voltage Vout is constant.

It is assumed here that a threshold value of the PMOS transistor 113 is represented by Vth, a difference between an input voltage and an output voltage of the level shift circuit 121 is represented by VLS, the gate voltage of the output transistor 110 is represented by VDRVG, and a gate voltage of the PMOS transistor 113 is represented by VDRVG_H. A condition under which the level shift circuit 121 operates is expressed as follows.

$$VDD-VDRVGH_H>|Vth| \quad (1)$$

Further, the voltage VDRVG_H is expressed as follows.

$$VDRVG_H=VDRVG+VLS \quad (2)$$

The following holds based on Expressions (1) and (2).

$$VDRVG<VDD-|Vth|-VLS \quad (3)$$

Based on the above-mentioned expressions, the PMOS transistor 113 starts to cause a current to flow when the voltage VDRVG decreases from the power supply voltage VDD to be smaller than VDD−|Vth|−VLS, thereby starting a clamping operation. A voltage VDRVG at which the PMOS transistor 113 starts the clamping operation is referred to as a clamp level. By setting the clamp level to a voltage around a withstand voltage of the gate of the output transistor 110, a gate-source voltage of the output transistor 110 can be increased while a breakdown of the gate is prevented, which enables the operation in a high drivability region. In this manner, the drivability is increased, and hence a dropout voltage of the output voltage Vout can be made small even when an output current is increased.

Further, when the voltage VDRVG_H exceeds the threshold value of the PMOS transistor 113, the PMOS transistor 113 can steeply increase a current. Therefore, the PMOS transistor 113 can control the voltage VDRVG to be a desired clamp level even when a boost circuit is provided, which causes a larger current than normal to flow to the gate of the output transistor 110 to perform the control.

When a threshold value of the PMOS transistor 112 is set to the threshold value Vth of the PMOS transistor 113, VLS=|Vth| holds and Expression (3) is then expressed as follows.

$$VDRVG<VDD-2\times|Vth| \quad (4)$$

Based on Expression (4), the PMOS transistor 113 starts to cause a current to flow when the voltage VDRVG decreases from the power supply voltage VDD to be smaller than VDD−2×|Vth|, thereby starting the clamping operation. By increasing the clamp level to a voltage around the withstand voltage of the gate of the output transistor 110, the gate-source voltage of the output transistor 110 can be increased while the breakdown of the gate is prevented, which enables the operation in the high drivability region. In this manner, the drivability is increased, and hence the dropout voltage of the output voltage Vout can be made small even when the output current is increased.

Note that, when the same type of transistor is used for the PMOS transistor 113 and the output transistor 110, the transistors are less affected by variation in threshold value and a drivability of the output transistor 110 thus hardly varies. Further, the PMOS transistor 112 and the PMOS transistor 113 have the same threshold value in the above description, but the present invention is not limited to this configuration and may use transistors having different threshold values. In addition, the use in the voltage regulator is described above as an example, but the present invention can be used in any circuit configuration without limiting to the voltage regulator as long as the circuit configuration uses an output transistor such as an operational amplifier circuit.

As described above, the voltage regulator according to the first embodiment can protect the gate by controlling the clamp circuit by the output of the level shift circuit 121 without limiting the drivability of the output transistor 110.

Second Embodiment

Figure 2:
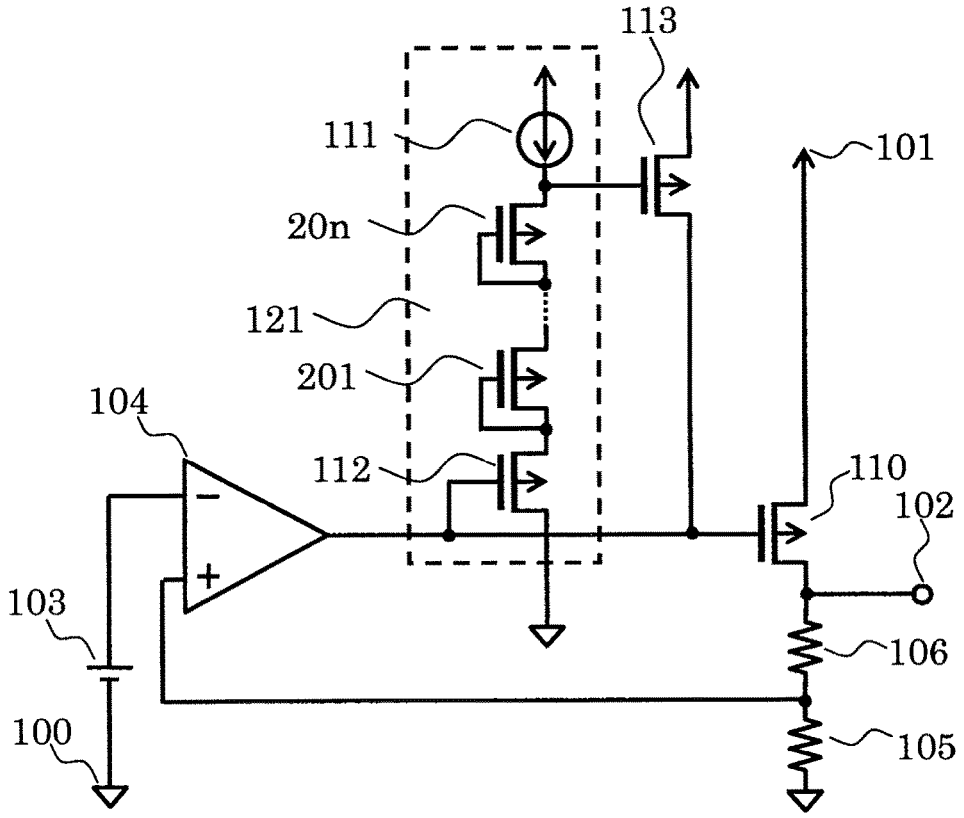
FIG. 2 is a circuit diagram illustrating a configuration of a voltage regulator according to a second embodiment of the present invention.

FIG. 2 is a circuit diagram of a voltage regulator according to a second embodiment of the present invention. FIG. 2 differs from FIG. 1 in that n PMOS transistors 201 to 20*n* that are diode-connected impedance elements are connected between the source of the PMOS transistor 112 and the gate of the PMOS transistor 113. The rest is the same as in FIG. 1.

An operation of the voltage regulator according to the second embodiment is described. A normal operation is the same as that in the first embodiment.

When a threshold value of the diode-connected PMOS transistor is represented by Vth similarly to the threshold value of the PMOS transistor 112, VLS=|Vth|+n×|Vth|=(n+1)×|Vth| holds, and Expression (3) is then expressed as follows.

$$VDRVG<VDD-n+2)\times|Vth| \quad (5)$$

Based on Expression (5), the PMOS transistor 113 starts to cause a current to flow when the voltage VDRVG decreases from the power supply voltage VDD to be smaller than VDD−(n+2)×|Vth|, thereby starting the clamping operation.

When the level shift circuit 121 is configured in this manner, the clamp level can be easily adjusted by changing the number of the diode-connected PMOS transistors.

As described above, the voltage regulator according to the second embodiment can protect the gate by controlling the clamp circuit by the output of the level shift circuit 121 without limiting the drivability of the output transistor 110. Further, the clamp level can be easily adjusted by changing the number of the diode-connected PMOS transistors 201 to 20*n*.

Third Embodiment

Figure 3:
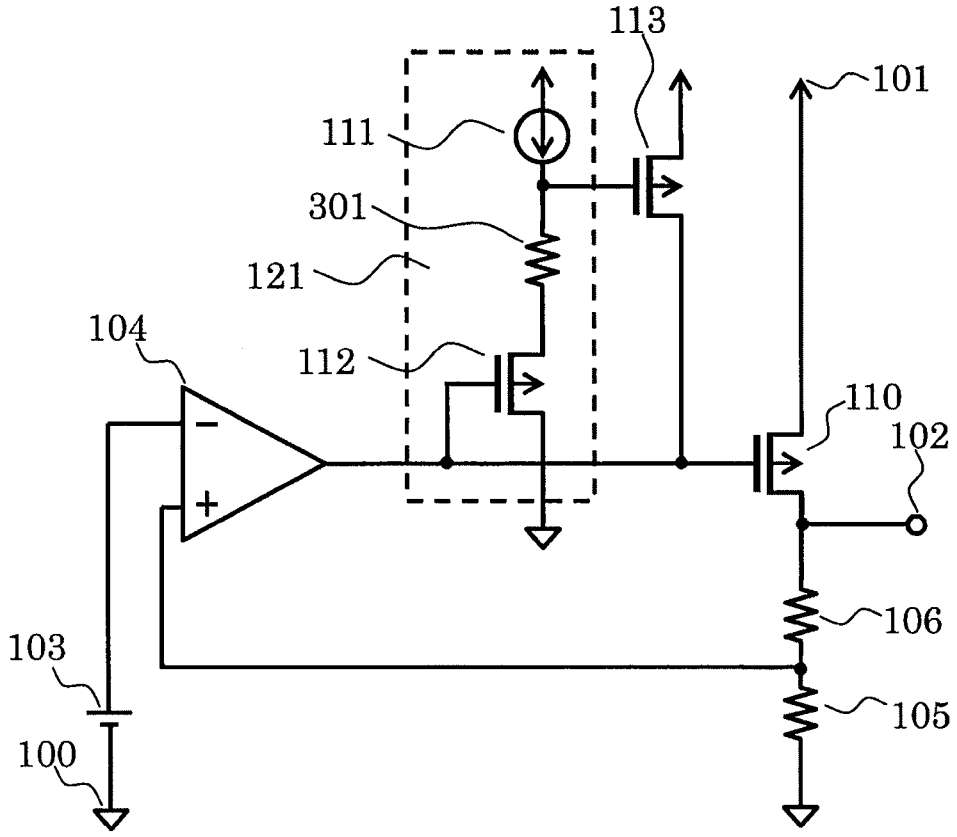
FIG. 3 is a circuit diagram illustrating a configuration of a voltage regulator according to a third embodiment of the present invention.

FIG. 3 is a circuit diagram of a voltage regulator according to a third embodiment of the present invention. FIG. 3 differs from FIG. 1 in that a resistor 301 that is an impedance element is connected between the source of the PMOS transistor 112 and the gate of the PMOS transistor 113. The rest is the same as in FIG. 1.

An operation of the voltage regulator according to the third embodiment is described. A normal operation is the same as that in the first embodiment.

When a resistance value of the resistor 301 is represented by R1 and a current of the constant current circuit 111 is represented by I1, Expression (3) is then expressed as follows.

$$VDRVG < VDD - 2 \times |Vth| - I1 \times R1 \quad (6)$$

Based on Expression (6), the PMOS transistor 113 starts to cause a current to flow when the voltage VDRVG decreases from the power supply voltage VDD to be smaller than VDD−2×|Vth|−I1×R1, thereby starting the clamping operation.

With this configuration, the clamp level can be easily adjusted by changing the resistance value R1 of the resistor 301.

As described above, the voltage regulator according to the third embodiment can protect the gate to prevent the breakdown of the gate by controlling the clamp circuit by the output of the level shift circuit 121 without limiting the drivability of the output transistor 110. Further, the clamp level can be easily adjusted by changing the resistance value of the resistor 301.

Fourth Embodiment

Figure 4:
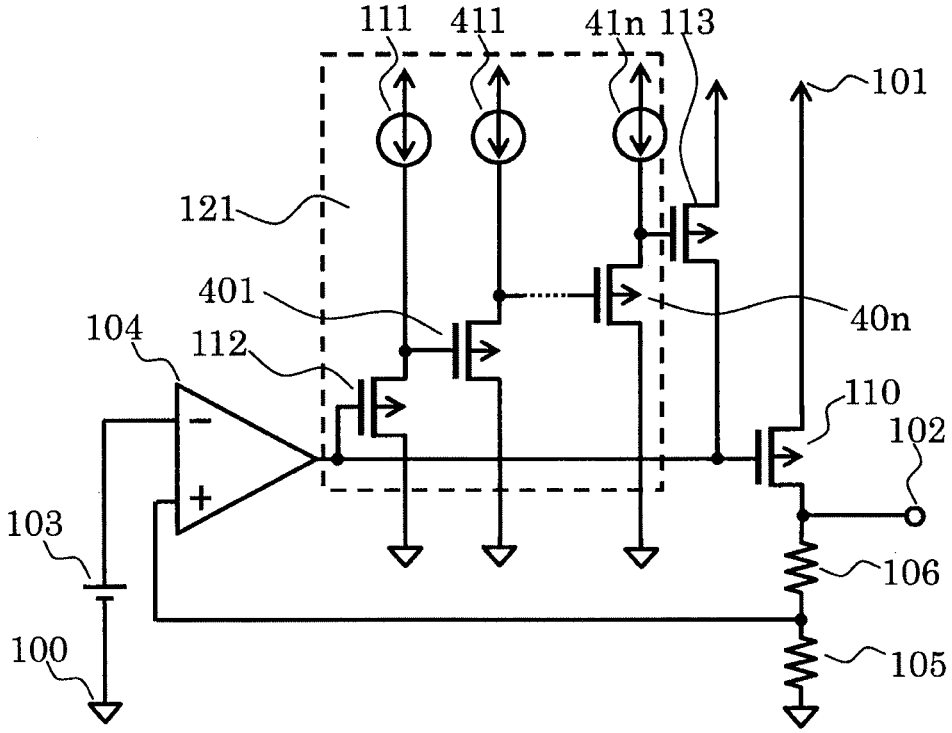
FIG. 4 is a circuit diagram illustrating a configuration of a voltage regulator according to a fourth embodiment of the present invention.

FIG. 4 is a circuit diagram of a voltage regulator according to a fourth embodiment of the present invention. FIG. 4 differs from FIG. 1 in that PMOS transistors 401 to 40*n* having sources respectively connected to constant current circuits 411 to 41*n* are connected between the source of the PMOS transistor 112 and the gate of the PMOS transistor 113. The rest is the same as in FIG. 1.

An operation of the voltage regulator according to the fourth embodiment is described. A normal operation is the same as that in the first embodiment.

When a threshold value of each of the PMOS transistors 401 to 40*n* is represented by Vth similarly to the threshold value of the PMOS transistor 112, VLS=|Vth|+n×|Vth|=(n+1)×|Vth| holds and Expression (3) is then expressed as follows.

$$VDRVG < VDD - (n+2) \times |Vth| \quad (7)$$

Based on Expression (7), the PMOS transistor 113 starts to cause a current to flow when the voltage VDRVG decreases from the power supply voltage VDD to be smaller than VDD−(n+2)×|Vth|, thereby starting the clamping operation. With this configuration, the clamp level can be easily adjusted by changing the number of the PMOS transistors 401 to 40*n*.

Note that, the PMOS transistor 112 and the PMOS transistors 401 to 40*n* have the same threshold value in the above description, but the present invention is not limited to this configuration and may use transistors having different threshold values. In addition, the use in the voltage regulator is described above as an example, but the present invention can be used in any circuit configuration without limiting to the voltage regulator as long as the circuit configuration uses an output transistor such as an operational amplifier circuit.

As described above, the voltage regulator according to the fourth embodiment can protect the gate to prevent the breakdown of the gate by controlling the clamp circuit by the output of the level shift circuit 121 without limiting the drivability of the output transistor 110. Further, the clamp level can be easily adjusted by changing the number of the PMOS transistors 401 to 40*n*.

Fifth Embodiment

Figure 5:
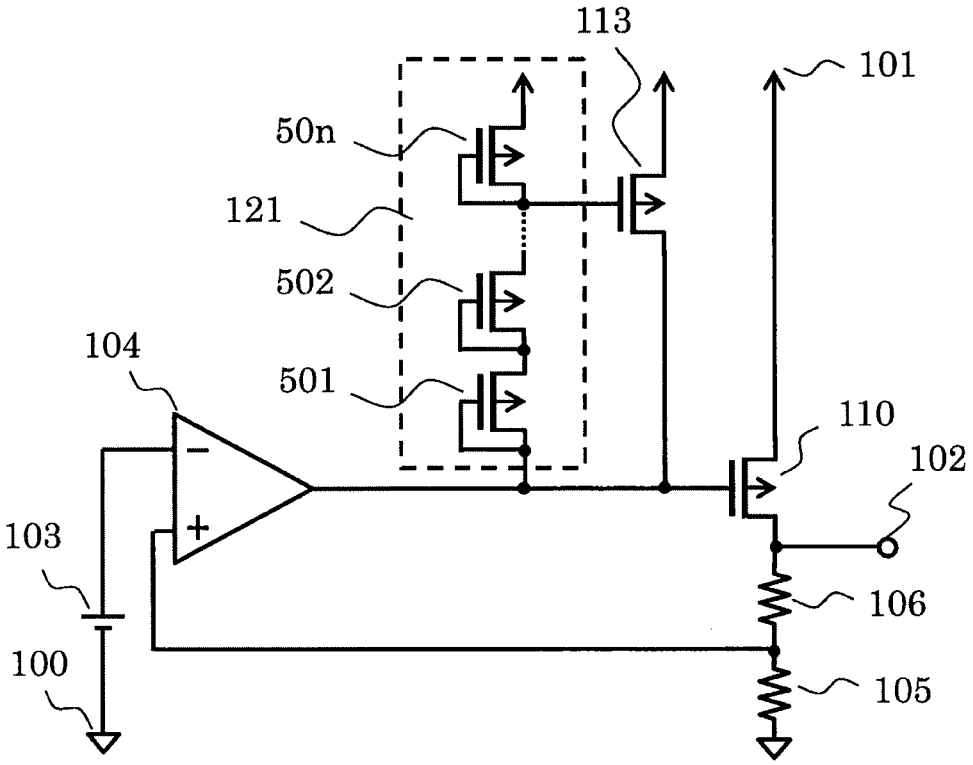
FIG. 5 is a circuit diagram illustrating a configuration of a voltage regulator according to a fifth embodiment of the present invention.
Figure 6:
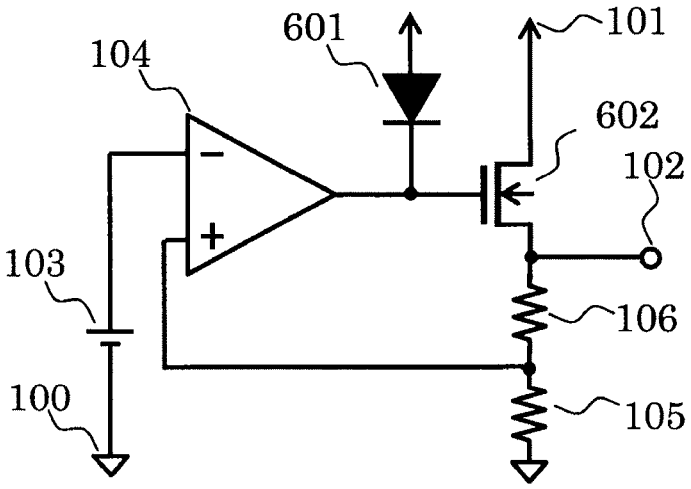
FIG. 6 PRIOR ART
FIG. 6 is a circuit diagram illustrating a configuration of a related-art voltage regulator.

FIG. 5 is a circuit diagram of a voltage regulator according to a fifth embodiment of the present invention. FIG. 5 differs from FIG. 1 in that the PMOS transistor 112 and the constant current circuit 111 are omitted and n diode-connected PMOS transistors 501 to 50*n* are used.

Connections in the voltage regulator according to the fifth embodiment are described. The PMOS transistors 501 to 50*n* each having a gate and a drain connected to each other are connected in series. The PMOS transistor 501 has the gate and the drain connected to the gate of the output transistor 110 and a source connected to the gate and the drain of the PMOS transistor 502. The n-th PMOS transistor 50*n* connected in series has the gate and the drain connected to the gate of the PMOS transistor 113 and a source connected to the power supply terminal 101. The rest is the same as in FIG. 1.

An operation of the voltage regulator according to the fifth embodiment is described. A normal operation is the same as that in the first embodiment.

When a threshold value of each of the PMOS transistors 501 to 50*n* is represented by Vth similarly to the threshold value of the PMOS transistor 113, VLS=(n−1)×|Vth| holds and Expression (3) is then expressed as follows.

$$VDRVG < VDD - n \times |Vth| \quad (8)$$

Based on Expression (8), the PMOS transistor 113 starts to cause a current to flow when the voltage VDRVG decreases from the power supply voltage VDD to be smaller than VDD−n×|Vth|, thereby starting the clamping operation. With this configuration, the clamp level can be easily adjusted by changing the number of the PMOS transistors 501 to 50*n*.

Note that, the PMOS transistor 113 and the PMOS transistors 501 to 50*n* have the same threshold value in the above description, but the present invention is not limited to this configuration and may use transistors having different threshold values. In addition, the use in the voltage regulator is described above as an example, but the present invention can be used in any circuit configuration without limiting to the voltage regulator as long as the circuit configuration uses an output transistor such as an operational amplifier circuit.

As described above, the voltage regulator according to the fifth embodiment can protect the gate to prevent the breakdown of the gate by controlling the clamp circuit by the output of the level shift circuit 121 without limiting the drivability of the output transistor 110. Further, the clamp level can be easily adjusted by changing the number of the PMOS transistors 501 to 50*n*.

What is claimed is:

1. A voltage regulator, comprising:

a power supply terminal configured to input a power supply voltage;

a reference voltage circuit configured to output a reference voltage;

an output transistor;

an error amplifier circuit configured to amplify and output a difference between a divided voltage and the reference voltage, the divided voltage being obtained by dividing an output voltage output from the output transistor, to thereby control a gate of the output transistor;

a clamp circuit connected between the gate of the output transistor and the power supply terminal, the clamp circuit's operation starting at a predetermined clamp level at which a gate voltage of the output transistor decreases from a withstand voltage of the gate of the output transistor; and a level shift circuit including at least one transistor and a constant current circuit including one terminal connected to the power supply terminal and connected to the gate of the output transistor and an input terminal of the clamp circuit, where at least one transistor comprises a first transistor including a gate connected to the input terminal of the level shift circuit, a source connected to another terminal of the constant current circuit and the output terminal of the level shift circuit, and a drain connected to a ground terminal;

wherein the level shift circuit controls the clamp circuit by setting and adjusting the predetermined clamp level with an output voltage of the level shift circuit, thereby protecting a gate of the output transistor and increasing a gate-source voltage of the output transistor, wherein the predetermined clamp level is higher than an absolute value of a threshold voltage of the transistor.

2. The voltage regulator according to claim 1, wherein the level shift circuit further comprises an impedance element between the constant current circuit and the first transistor.

3. The voltage regulator according to claim 1, wherein the level shift circuit further comprises:

a second constant current circuit including one terminal connected to the power supply terminal;

a second transistor including a gate connected to the source of the first transistor and a source connected to another terminal of the second constant current circuit;

an n-th constant current circuit, where n is an integer of 2 or more, the n-th constant current circuit including one terminal connected to the power supply terminal; and an n-th transistor including a gate connected to a source of an (n−1)th transistor and a source connected to another terminal of the n-th constant current circuit and the output terminal of the level shift circuit.

4. The voltage regulator according to claim 2, wherein the impedance element comprises one of a resistor and a diode-connected transistor.

5. A voltage regulator, comprising:

a power supply terminal configured to input a power supply voltage;

a reference voltage circuit configured to output a reference voltage;

an output transistor;

an error amplifier circuit configured to amplify and output a difference between a divided voltage and the reference voltage, the divided voltage being obtained by dividing an output voltage output from the output transistor, to thereby control a gate of the output transistor;

a clamp circuit connected between the gate of the output transistor and the power supply terminal, the clamp circuit's operation starting at a predetermined clamp level at which a gate voltage of the output transistor decreases from a withstand voltage of the gate of the output transistor; and a level shift circuit including at least one transistor and a constant current circuit and connected to the gate of the output transistor and an input terminal of the clamp circuit, wherein the level shift circuit controls the clamp circuit by setting and adjusting the predetermined clamp level with an output voltage of the level shift circuit, thereby protecting a gate of the output transistor and increasing a gate-source voltage of the output transistor, wherein the predetermined clamp level is higher than an absolute value of a threshold voltage of the transistor:

wherein the level shift circuit comprises n transistors, where n is an integer of 2 or more, the n transistors being connected in series between the gate of the output transistor and the power supply terminal and each including a gate and a drain connected to each other, wherein the gate and the drain of the first transistor of the n transistors are connected to the input terminal of the level shift circuit, and wherein the gate and the drain of the n-th transistor of the n transistors are connected to the output terminal of the level shift circuit, the n-th transistor including a source connected to the power supply terminal.

6. A semiconductor device, comprising:

an operational amplifier circuit;

an output transistor including a gate connected to an output of the operational amplifier circuit;

a clamp circuit connected to a gate of the output transistor, the clamp circuit's operation starting at a predetermined clamp level at which a gate voltage of the output transistor decreases from a withstand voltage of the gate of the output transistor; and a level shift circuit including at least one transistor and a constant current circuit and connected to the gate of the output transistor and an input terminal of the clamp circuit, wherein the level shift circuit controls the clamp circuit by setting and adjusting the predetermined clamp level with an output voltage of the level shift circuit, thereby protecting a gate of the output transistor and increasing a gate-source voltage of the output transistor;

wherein at least one transistor comprises a first transistor including a gate connected to the input terminal of the level shift circuit and a source connected to the constant current circuit and the output terminal of the level shift circuit wherein the predetermined clamp level is higher than an absolute value of a threshold voltage of the transistor.

7. The semiconductor device according to claim 6, wherein the level shift circuit further comprises an impedance element between the constant current circuit and the first transistor.

8. The semiconductor device according to claim 6, wherein the level shift circuit comprises n transistors, where n is an integer of 2 or more, the n transistors being connected in series between the gate of the output transistor and a power supply terminal and each including a gate and a drain connected to each other, wherein the gate and the drain of the first transistor of the n transistors are connected to the input terminal of the level shift circuit, and wherein the gate and the drain of the n-th transistor of the n transistors are connected to the output terminal of the level shift circuit, the n-th transistor including a source connected to the power supply terminal.

9. The semiconductor device according to claim 6, wherein the first constant current circuit including one terminal connected to a power supply terminal; and the level shift circuit further comprises:

a second constant current circuit including one terminal connected to the power supply terminal;

a second transistor including a gate connected to the source of the first transistor and a source connected to another terminal of the second constant current circuit;

an n-th constant current circuit, where n is an integer of 2 or more, the n-th constant current circuit including one terminal connected to the power supply terminal; and an n-th transistor including a gate connected to a source of an (n−1)th transistor and a source connected to another terminal of the n-th constant current circuit and the output terminal of the level shift circuit.

10. The semiconductor device according to claim 7, wherein the impedance element comprises one of a resistor and a diode-connected second transistor.

* * * * *